US007955105B2

(12) United States Patent
Maeland

(10) Patent No.: US 7,955,105 B2
(45) Date of Patent: Jun. 7, 2011

(54) CONNECTOR ARRANGEMENT WITH PENETRATOR IN A SUBMERSIBLE ELECTRICAL ASSEMBLY

(75) Inventor: Elin Maeland, Oslo (NO)

(73) Assignee: Vetco Gray Scandinavia AS, Sandvika (NO)

( * ) Notice: Subject to any disclaimer, the term of this patent is extended or adjusted under 35 U.S.C. 154(b) by 74 days.

(21) Appl. No.: 12/306,799

(22) PCT Filed: Jul. 2, 2007

(86) PCT No.: PCT/IB2007/001807

§ 371 (c)(1),
(2), (4) Date: Dec. 29, 2008

(87) PCT Pub. No.: WO2008/004079

PCT Pub. Date: Jan. 10, 2008

(65) Prior Publication Data

US 2009/0197447 A1 Aug. 6, 2009

(30) Foreign Application Priority Data

Jun. 30, 2006 (NO) ..... 20063065

(51) Int. Cl.
*H01R 4/60* (2006.01)

(52) U.S. Cl. ..... 439/191; 439/201

(58) Field of Classification Search ..... 439/191, 439/20, 179

See application file for complete search history.

(56) References Cited

U.S. PATENT DOCUMENTS 3,643,207 A 2/1972 Cairns
3,877,775 A 4/1975 Barlow et al.
4,940,416 A 7/1990 Wagaman et al.
2002/0160640 A1 * 10/2002 Korpan et al. ..... 439/191
2003/0100209 A1 * 5/2003 Kerscher et al. ..... 439/191
2004/0266240 A1 * 12/2004 Abbey et al. ..... 439/201

FOREIGN PATENT DOCUMENTS

JP 2000227092 A 8/2000
WO WO-99/34495 A1 7/1999

OTHER PUBLICATIONS

Norwegian Search Report—Jan. 15, 2007.
PCT/ISA/210—International Search Report—Jan. 23, 2008.
PCT/ISA/237—Written Opinion of the International Searching Authority—Jan. 23, 2008.

* cited by examiner

*Primary Examiner* — Hien Vu
(74) *Attorney, Agent, or Firm* — Venable LLP; Eric J. Franklin

(57) ABSTRACT

A connector arrangement in a submersible electrical assembly including an electric equipment or electrical power consumer housed in an enclosure filled with conductive fluid. Power is supplied to the power consumer in a connecting area defined through a dielectric containment located inside the enclosure, and to a penetrator comprising power cable termination components enclosed in a penetrator housing extending from a rear end to a forward end of the penetrator. The rear end is arranged to seal about a power cable receivable in the housing from the rear end. The forward end exposes a connector arranged for electrically connecting the power consumer to the penetrator. The penetrator housing in the forward end is extended beyond the connector through a housing section projecting into the power consumer enclosure and terminated in a forward end by an end wall. The end wall has a passage sealable about a power consumer conductor mateable with the connector of the penetrator in a connecting mode.

16 Claims, 2 Drawing Sheets

CONNECTOR ARRANGEMENT WITH PENETRATOR IN A SUBMERSIBLE ELECTRICAL ASSEMBLY

CROSS-REFERENCE TO RELATED APPLICATIONS

This application claims priority to Norwegian patent application 20063065 filed 30 Jun. 2006 and is the national phase under 35 U.S.C. §371 of PCT/IB2007/001807 filed 2 Jul. 2007.

TECHNICAL FIELD OF THE INVENTION

The present invention refers to a connector arrangement with a penetrator in a submersible electrical assembly wherein electric power is supplied to a power consumer from which heat is transferred via a conductive fluid that is flushed through an enclosure separating the submersible electrical assembly from the ambient sea.

BACKGROUND AND PRIOR ART

In submersible applications, such as in the off-shore industry, cooling of submerged electrical equipment and power consumers is achievable by flushing the equipment with a coolant fluid. The coolant may be a gaseous or liquid fluid that is circulated about the equipment to be cooled, transferring heat energy from the electrical equipment to the sea directly or indirectly through heat exchangers. Operating conditions may include cooling fluid temperatures in the range of 70-160° C., and cooling fluid pressures rising above the ambient seawater pressures.

Electrical power is typically supplied to the submerged electrical application from shore—or surface-based generators via a power cable which is terminated in a pressure-compensated housing of a connector assembly, herein referred to as a penetrator. The penetrator housing is designed in a rear end to receive sealingly the power cable, and is designed in a forward or connecting end to penetrate an enclosure housing the electrical equipment and to connect electrically the power cable conductor with the internal electrical conductor.

In practice, several design parameters have to be considered in a penetrator adapted for conducting power to electric equipment in submersible applications. For example, in electrical applications where a coolant is electrically conductive, such as in the case of a motor flushed with conductive gas or seawater, e.g., the connection between penetrator and motor winding, or a cable spliced to the winding as the case may be, has to be performed in an electrically isolated environment. Another consideration relates to the choice of materials in sealing structures that need to be compatible with the subject coolant fluid. In order to meet these design requirements, penetrators for submersible applications usually need to be modified or adapted for each specific application.

The present invention is applicable to submersible applications in general. For purpose of illustration, a non-limiting example includes a motor application, such as the submerged motor driven pump published as JP 2000-227092. With reference to FIG. 1, a pump motor 13 is disclosed to be arranged in an inner cylinder 11A in a pump casing 1 inside which water is circulated. A lubricating oil is used for cooling a motor shaft seal 21. The oil is contained in an annular chamber 15, separating the inner cylinder 11A from the surrounding pump water. The circumferential continuity of the annular chamber 15 is interrupted by a chamber 16 which adjoins, by an inside face thereof, the exterior of the inner cylinder 11A. The outside of chamber 16 faces the pump water. Electrical equipment housed in chamber 16 is connectable to a power supply via a cable insert port 26 communicating the chamber 16 with the exterior of pump casing 1.

Devices for underwater termination of power cables are previously known, see WO 99/34495, e.g., wherein a device is disclosed comprising connectors arranged for penetration into the enclosure of an underwater power consumer. Each such penetrator comprises power cable termination components enclosed in a penetrator housing extending from a rear end to a forward end of the penetrator, the rear end arranged to seal about the isolation of a power supply cable received in the housing from the rear end, and the forward end exposing a connector arranged for electrically connecting the power consumer to the penetrator. The penetrators are pressure compensated by means of dielectric liquid contained in the penetrator housings.

It is further previously known to effect mating between conductors within a dielectric fluid volume, see e.g. U.S. Pat. No. 3,643,207. A sealed electrical connector is disclosed, comprising a first body part which is mateable with a second body part projecting from the exterior of a bulkhead. Power consumer conductors reach through the bulkhead into a chamber formed in the first body part. The chamber is filled with dielectric fluid such as nonconductive oil, grease or gel. Conductors projecting from the first body part are insertable into the chamber via slits formed in a diaphragm sealing the entrance into the chamber. A compressible boot member, open to the environment and reaching through the chamber, keeps the fluid volume in equilibrium with the ambient pressure.

SUMMARY OF THE INVENTION

The present application aims to provide a connector arrangement with a penetrator in a submersible electrical assembly, wherein structural measures are directed towards a greater freedom of penetrator design and adaptability in the supply of power to a submerged electrical equipment or unit via penetrators of different designs.

The present invention thus has as an object to provide a connection between power supply and power consumer in a submersible electrical assembly utilizing conductive fluid for cooling purposes.

In one aspect of the invention, an object is to provide a connection between power supply and power consumer in a submersible electrical assembly utilizing conductive production gas for cooling purposes.

In another aspect, an object of the present invention is to provide a penetrator in a connector arrangement adapted to electrically separate a connection between power supply and power consumer in a submersible electrical assembly utilizing conductive fluid for cooling purposes.

In yet another aspect, an object of the present invention is to provide a penetrator effective for electrically separating the connection between power supply and power consumer in a submersible electrical assembly utilizing conductive production gas for cooling purposes.

One or several of these objects are met in a connector arrangement with a penetrator as defined in appended claims, subordinated ones thereof reciting advantageous embodiments of the invention.

In brief, the invention discloses a connector arrangement in a submersible electrical assembly comprising a power consumer housed in an enclosure which is filled with conductive fluid, wherein power is supplied to the power consumer via a connecting area defined through a dielectric containment located inside the enclosure.

In one aspect of the invention, the dielectric containment is a housing section filled with dielectric fluid, the housing section separating the connecting area from electrically conductive fluid in the enclosure while providing access to the connecting area from outside the enclosure.

In one preferred embodiment, the connector arrangement is arranged to connect electrically a conductor, such as a cable or winding, of the power consumer to a power supply cable terminated in a penetrator which penetrates in connecting mode a wall of the enclosure. In this embodiment, the connector arrangement is characterized by a housing section containing dielectric fluid, the housing section projecting into the enclosure such that a rearward end of the housing section forms a mouth through a wall of the enclosure, wherein in connecting mode a conductor of said power consumer is sealingly received in the forward end of the housing section to mate, in the housing section within the enclosure, with a connector of the penetrator that is sealingly received in the mouthing rearward end of the housing section, the housing section thus defining an electrically isolated containment of the connecting area inside the enclosure, as well as means for at least one of pressure and volume compensation of the dielectric fluid in result of variations in pressure/temperature of the conductive fluid surrounding the housing section.

Advantageously, the enclosure is arranged to be connectable to a production gas line for fluid communication with an underwater gas or gas/oil well, the conductive fluid being production gas passing through the enclosure via an inlet and an outlet, respectively, arranged on the enclosure.

Other advantageous embodiments comprise:

- a housing section which in a forward end has an end wall with a passage sealing about the isolator of the conductor of the power consumer, and which in a rearward end carries a metal, an elastomer or a plastic seal sealing about the penetrator housing;
- a housing section which in the forward end has an end wall with a passage through which the conductor of the power consumer is passed into the housing section. Alternatively, the passage may advantageously be arranged so as to open into the housing section through a widened, arcuate mouth.
- a housing section which has a cylinder wall connecting in the forward end to an end wall and in said rearward end to a radially projecting flange abutting a wall of the power consumer enclosure;
- a housing section, the interior of which communicates with an expandable bellows.

In another aspect of the invention, the connector arrangement disclosed may advantageously incorporate a penetrator comprising power cable termination components enclosed in a penetrator housing extending from a rear end to a forward end of the penetrator, the rear end arranged to seal about the isolation of a power cable receivable in the housing from the rear end, and the forward end exposing a connector, such as a male or a female plug-in connector, arranged for electrically connecting a power consumer to the penetrator, wherein the penetrator housing in the forward end is extended beyond the plug-in connector through a housing section containing dielectric fluid and terminated in a forward end by an end wall, said end wall having a passage sealingly receiving a power consumer conductor mateable with the plug-in connector of the penetrator in connecting mode.

The housing section may be formed as an extended portion of the penetrator housing, and is advantageously formed integrally therewith. The housing section may alternatively be arranged to be separately mountable to the penetrator housing, in which case the housing section is advantageously sealed to the penetrator housing through a metal, an elastomer or a plastic seal.

In operative mode the housing section interior is filled with dielectric fluid which is pressure and/or volume compensated towards the internals of the electrical equipment enclosure through communication with an expandable bellows, or through a flexible housing section wall, e.g. The penetrator sealing wall takes up the differential pressure between the surrounding sea water and internals of the electrical assembly.

The housing section preferably is a metal housing.

The connector arrangement with penetrator of the present invention are both advantageously applied in underwater motor applications, in transformer applications, in variable speed or frequency controlled drives or converters, or in switchgear applications.

BRIEF DESCRIPTION OF THE DRAWINGS

Further details and advantages of the invention will be described in more detail below with reference made to the accompanying drawings, wherein.

DETAILED DESCRIPTION OF PREFERRED EMBODIMENTS OF THE INVENTION

Figure 1:
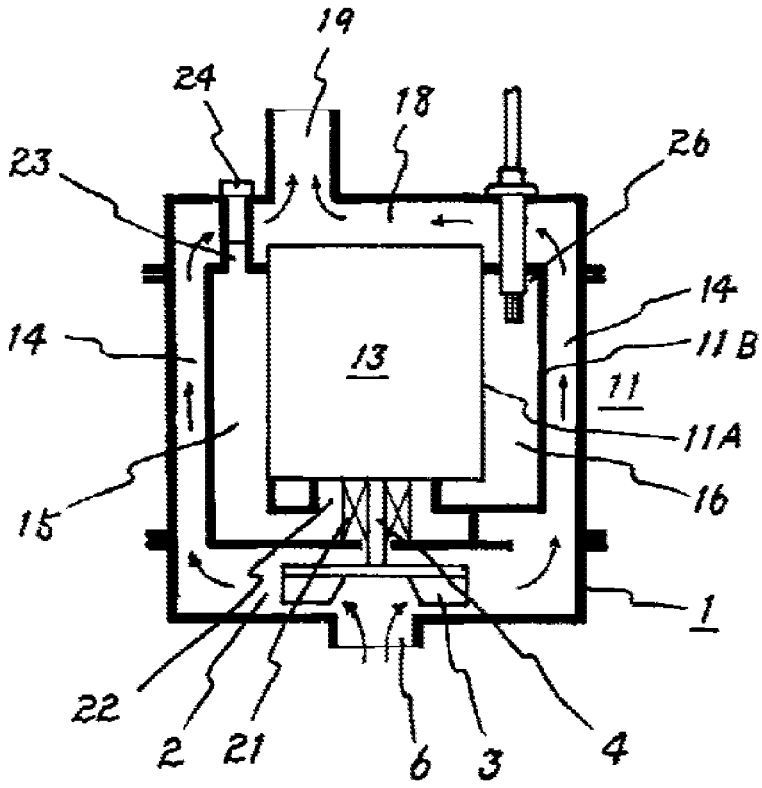
Fig. 1 (Prior Art)
FIG. 1 shows a submersible application comprising a prior art connector arrangement.

The prior art connector arrangement of FIG. 1 has been explained above. A non-limiting example of a connector arrangement with a penetrator according to the present invention is thus further explained and illustrated with reference to FIG. 2.

Figure 2:
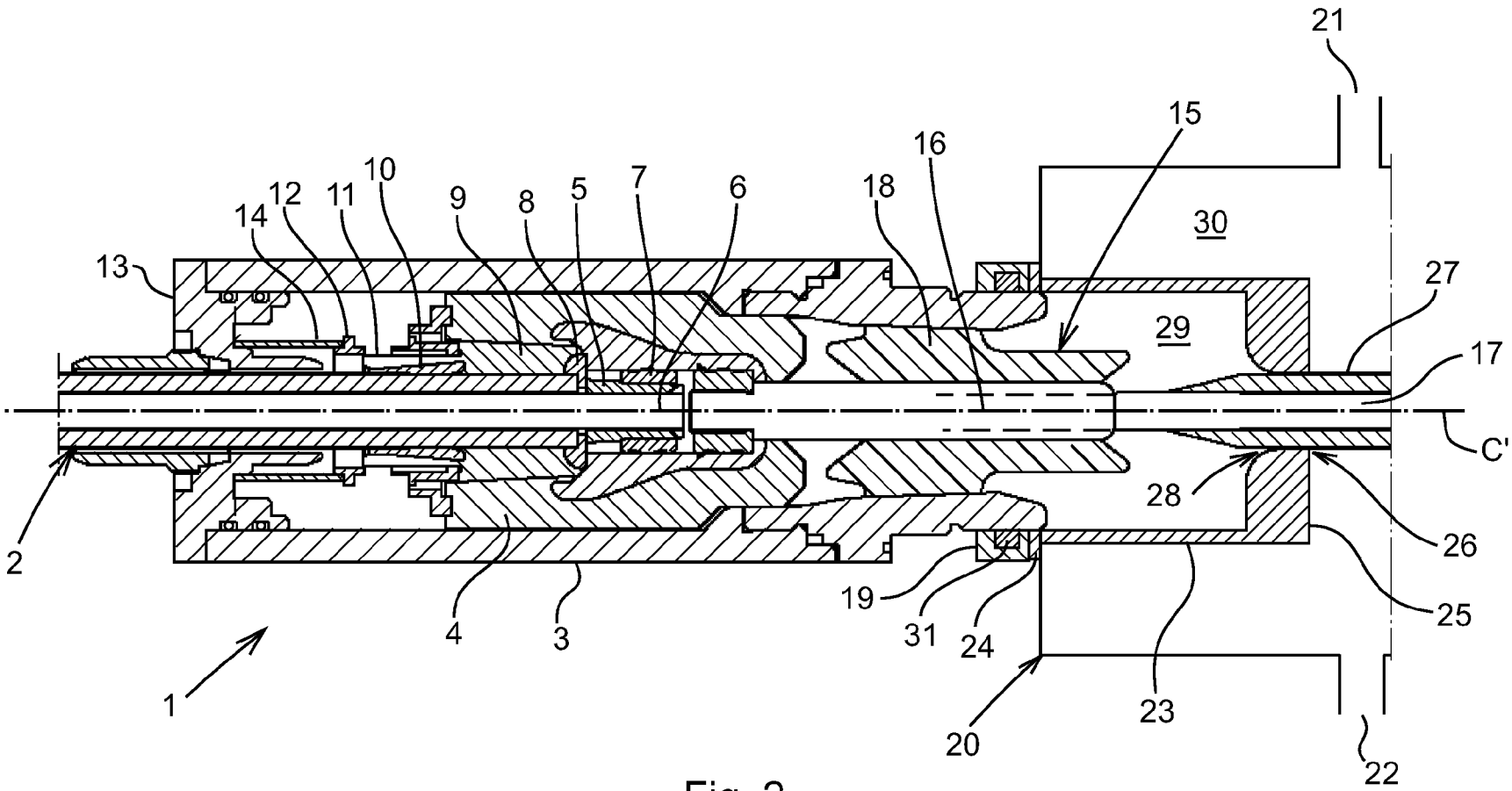
FIG. 2 is a longitudinal section through a connector arrangement with a penetrator according to an embodiment of the present invention.

With reference to FIG. 2, a penetrator 1 is shown in connecting mode wherein the penetrator 1 is operative for electrically connecting a submersible power consumer to a power source, such as a sea- or land-based power generator. The electrical power consumer may typically be an electric motor, albeit the present invention is not limited to motor applications but is likewise useful in any submersible application wherein electrical power is supplied at a connecting area surrounded by a conductive media.

Power is supplied via a power cable 2 which is terminated inside a metal penetrator housing 3 containing power cable termination components electrically separated form the penetrator housing by accommodation within an insulator body 4. The cable termination components typically include at least a cone clamp 5 sitting on the unsheathed conductor end 6 of the power cable, a contact ring 7, a centering piece 8, a stress cone 9, and a pressure bolt 10 loaded by a spring 11 which acts between the pressure bolt and a seat 12 which is solidly abutting a forward side of an end plate 13 of the penetrator housing 3 via a cylindrical sleeve 14. The power cable is received in the penetrator via a passage through the end plate 13, sealing about the isolator of the power cable.

The penetrator housing 3 of the illustrated embodiment extends longitudinally from the end plate 13 at a rear end thereof to a forward end exposing a connector 15, such as a ceramic insert plug or other penetrator solution, which is accessible from the forward end of the penetrator housing for electrically connecting the power consumer to the penetrator.

Other embodiments, though not illustrated in drawings, may comprise penetrator housings having an angularly offset rear end receiving the power cable under an angle with respect to the longitudinal.

The connector 15 of the illustrated embodiment comprises a male or a female connecting pin 16 mating in connecting mode with a conductor 17 by which power is supplied from the penetrator to the power consumer, the latter in this context being any type of electrical equipment or unit operable in submerged applications. In a motor application, e.g., the conductor 17 may be the electrical winding of a motor, or a motor cable spliced to the motor winding. Alternatively, the connection between connecting pin 16 and conductor 17 is accomplishable through a cable lug or similar means. The connecting pin 16 is separated from the penetrator housing through a plug 18, such as a ceramic or epoxy insert plug, sealing against the inner periphery of the penetrator housing. The inner volume of penetrator housing 3 is typically filled with a dielectric fluid, captured behind the plug 18 and the rear wall 13 and adapting to variations in external pressure, such as through communication with an expandable bellows, e.g. (not shown in the drawing). The plug 18 provides a sealing wall that takes up differential pressures between surrounding seawater and the internals of an enclosure, housing the electrical equipment as explained below.

Most of the components heretofore described are rotationally symmetric about a symmetry axis C. In the forward end of the penetrator housing 3, a circumferential shoulder 19 is arranged for attaching the penetrator sealingly against a wall of a power consumer enclosure, in the drawing schematically indicated by reference number 20, and which, in the disclosed non-limiting motor application embodiment, represents a motor enclosure 20. The enclosure 20 typically contains a fluid, gaseous or liquid, protecting the equipment enclosed and isolating the electrical conducting internal parts from the surrounding seawater. In applications where heat energy is produced by operation of the power consumer, such as in a motor application, e.g., cooling may be achieved by flushing the volume of enclosure 20 with coolant fluid. The coolant may be a gas or a liquid that is circulated inside the enclosure and transfers the generated heat to the sea via a heat exchanger, or may be seawater that is fed through the housing, e.g.

In the production of gas from underwater gas or gas/oil wells, production gas is available for cooling purposes by communicating the enclosure interior with a production gas line from an underwater gas or gas/oil well, via an inlet and an outlet 21 and 22, respectively, arranged to communicate with the interior of the enclosure 20.

As seawater and production gas conduct electricity, the connecting area where connection between penetrator connector 15 and power consumer conductor 17 is established needs to be isolated. According to the present invention, the penetrator housing is for this purpose extended forward beyond the connector 15 through a metal housing section 23. The housing section 23 may be formed as an integrated, cylindrical extension of the penetrator housing 3, or formed as a separate element mountable to the penetrator housing. In the latter case, a radially projecting flange formation 24 in an open rearward end of the housing section 23 may be arranged to meet with the circumferential shoulder 19 on the penetrator housing 3, said flange sealingly clamped between the shoulder and enclosure wall in connected mode of the penetrator. In a forward end, the housing section 23 terminates through an end wall 25 formed with a passage 26 through which the power consumer conductor 17 passes into the housing section upon mating with the penetrator connector 15. The passage 26 is arranged to seal about the cable isolation layer 27 as the power consumer conductor is received inside the housing section 23.

In a case of a semi-conductive cable isolation layer 27, the passage 26 advantageously opens in the rear side of end wall 25 through a mouth 28 shaped in consideration of reducing electric field stress in the area where the cable isolation 27 is ended. The passage mouth may be arcuately widened as indicated in the drawing, or possess any suitable design conceivable by a person skilled in the art of high voltage connectors. In a case of a non-conductive cable isolation layer, e.g., a similar widening of the passage may be formed in the forward side of the end wall 25, or the end wall be designed to have a thickness that is sufficient to avoid electrically overstressing the material of the isolation 27. Alternative embodiments comprise an end-wall 25 having straight planar sides transversely adjoining the periphery of the isolation 27 under right or sloping angles, or any possible combination of planar, rounded or beveled mouths at the passage 26. Also conceivable, the passage 26 may be extended beyond the end-wall 25 in one or both ends of the passage, forming in this case a lug or a cylindrical sleeve about the conductor which enters through the passage.

The inner volume of housing section 23 is filled with a dielectric fluid 29, such as oil, adapting to variations in external pressure or temperature such as through communication with an expandable bellows, e.g., or in effect of a flexible housing wall provided through the inherent elasticity of material in the housing section wall, or through locally forming the wall for elastic deformation as is known in the art and therefore not explicitly shown in the drawing.

In the connecting mode illustrated in the drawing, the housing section 23 filled with dielectric fluid 29 penetrates into conductive fluid 30, such as production gas, filling the enclosure 20, the housing section thus defining an electrically isolated containment of the connecting area inside the enclosure.

Though explained above as an element integrated in or separately mountable to the penetrator housing 3, the housing section 23 may alternatively be arranged for mounting to the enclosure 20 with the rear end of housing section 23 forming a mouth in or through the wall of the enclosure 20, said rear end being arranged to receive the connector end of the penetrator 1. In alternative embodiments, the shoulder 19 and flange 24 may be integrally formed in the rearward end of the housing section, the shoulder carrying a sealing element 31 at the interface between housing section 23 and abutting surface of penetrator housing 3. A metal seal 31 may be preferred, such in cases of separating a gas filled volume from a liquid filled one, even though other materials are possible for the seal 31, such as elastomer or plastics material, for example a PTFE-material (such as Teflon®).

It is to be understood that the above embodiments have been described only by way of examples, and that, of course, alternative embodiments within the scope of the invention, as defined in the appended claims, will be conceivable for a person skilled in the art guided by the teachings provided herein.

The invention claimed is:

1. A connector arrangement with a penetrator in a submersible electrical assembly, arranged to connect electrically a power consumer, which is housed in an enclosure containing a conductive fluid, to a power supply cable terminated in the penetrator which penetrates in connecting mode a wall of the enclosure, the connector arrangement comprising:

a conductive housing section containing dielectric fluid, the housing section projecting into the enclosure such that a rearward end of the housing section forms a mouth through a wall of the enclosure, wherein in connecting mode a conductor having a cable insulation layer of said power consumer is received through a passage sealing about the conductor in a forward end of the housing section to mate with a connector of the penetrator as the penetrator is sealingly by a sealing material received in said mouth formed in the rearward end of the housing section, the housing section thus defining an electrically isolated containment of a connecting area inside the enclosure, and a compensator configured to compensate at least one of pressure and volume of the dielectric fluid in the housing section in result of variations in pressure/temperature of the conductive fluid in the enclosure surrounding the housing section.

2. The connector arrangement according to claim 1, wherein the housing section comprises a cylinder wall connecting in said forward end to an end wall and in said rearward end connecting to a radially projecting flange abutting the wall of the power consumer enclosure, in connecting mode.

3. The connector arrangement according to claim 2, wherein the end wall comprises a passage there through sealing about an isolator of the conductor in connecting mode.

4. The connector arrangement according to claim 3, wherein the passage opens into the housing section through a widened, arcuate mouth.

5. The connector arrangement according to claim 1, wherein the rearward end of the housing section comprises a metal, an elastomer or a plastics material seal sealing about a housing of the penetrator.

6. The connector arrangement according to claim 1, wherein the compensator comprises an expandable bellows in communication with an interior of said housing section.

7. The connector arrangement according to claim 1, wherein the enclosure is connectable to a production gas line for fluid communication with an underwater gas or gas/oil well, the conductive fluid being production gas passing through the enclosure via an inlet and an outlet, respectively, arranged on the enclosure.

8. The connector arrangement according to claim 1, wherein the electrical power consumer comprises a submersible electric motor.

9. The connector arrangement according to claim 1, wherein the housing section is an extended portion of a penetrator housing.

10. The connector arrangement according to claim 1, wherein the penetrator comprises power cable termination components enclosed in a penetrator housing extending from a rear end to a forward end of the penetrator, the rear end arranged to seal about the isolation of a power supply cable receivable in the housing from the rear end, and the forward end exposing a connector arranged for electrically connecting a power consumer to the penetrator, wherein the penetrator housing in the forward end is extended beyond the connector through a housing section containing dielectric fluid and terminated in a forward end by an end wall, said end wall having a passage sealingly receiving a power consumer conductor mateable with the connector of the penetrator in connecting mode.

11. The connector arrangement according to claim 10, wherein the housing section is sealed to the penetrator housing through a metal, an elastomer, or a plastics material seal.

12. The connector arrangement according to claim 10, wherein the housing section is a metal housing.

13. The connector arrangement according to claim 10, wherein the housing section comprises a flexible wall.

14. The connector arrangement according to claim 10, wherein the compensator comprises an expandable bellows in communication with an interior of the housing section.

15. The connector arrangement according to claim 10, wherein the housing section is separately mountable to the penetrator housing.

16. The connector arrangement according to claim 10, wherein the housing section is formed integrally with the penetrator housing.

* * * * *